United States Patent [19]

Miller

[11] Patent Number: 4,577,766

[45] Date of Patent: Mar. 25, 1986

[54] COAT HANGER SUPPORT

[76] Inventor: Charles R. Miller, 6123 S. Quebec, Tulsa, Okla. 74136

[21] Appl. No.: 481,381

[22] Filed: Mar. 28, 1983

[51] Int. Cl.[4] ..... A47F 5/00

[52] U.S. Cl. ..... 211/123; 211/113

[58] Field of Search ..... 211/123, 113, 124, 206, 211/118, 189, 119, 204

[56] References Cited

U.S. PATENT DOCUMENTS

| | | | |
|---|---|---|---|
| 2,868,389 | 1/1959 | Friend | 211/123 |
| 2,895,618 | 7/1959 | Nathan | 211/123 |
| 3,481,483 | 12/1969 | Harvey et al. | 211/123 X |
| 4,361,241 | 11/1982 | Stoddard | 211/123 |

*Primary Examiner*—Robert W. Gibson, Jr.
*Attorney, Agent, or Firm*—William S. Dorman

[57] ABSTRACT

A finned tube support for coat hangers comprising a hollow plastic tube of sufficient length and sufficient internal diameter to slip over a closet rod of the type normally employed for holding hangers thereon in a closet, the plastic tube having a wall thickness of between about 1/32 and 1/16 inch, a plurality of circular plastic disks mounted in spaced parallel relation on the tube and at right angles to the longitudinal central axis of the tube, the disks having an axial thickness of about 1/16 of an inch and a central opening equal to the outer diameter of the tube, the disk having an outer diameter equal to about 2 and ½ inches, the center-to-center spacing from one disk to the next adjacent disk being equal to about ½ inch. The plastic tube, between adjacent plastic disks, is provided with centering recesses of various and different shapes for centering a coat hanger between the disks.

20 Claims, 21 Drawing Figures

COAT HANGER SUPPORT

FIELD OF THE INVENTION

The present invention relates to a support for coat hangers. More particularly, this invention involves a finned tube support adapted to be slipped over a closet rod for separating adjacent coat hangers, and wherein the tube is provided with centering recesses between adjacent fins or disks.

PRIOR ART

It is conventional practice to store coats, shirts and other garments on hangers in a closet or the like by placing the hook portion of the hanger over a metal or wooden rod which is customarily supported at its ends from the side walls of the closet. Difficulty has been experienced in the past in maintaining the coat hangers in spaced relation with respect to each other so that a given garment can be removed from the closet without interferring with the garments on adjacent coat hangers.

In my prior co-pending Application Ser. No. 422,301, filed Nov. 17, 1982 and entitled "Finned Tube Support for Coat Hangers", there is described and claimed a hollow plastic tube adapted to fit over a closet rod and having a plurality of parallel circular disks or fins thereon separated from each other by at least the thickness or width of any commercially available coat hanger. In this regard, the present invention constitutes an improvement over that disclosed in my prior co-pending application in that the portions of the tube between adjacent disks are provided with centering recesses for the coat hangers.

SUMMARY OF THE INVENTION

The present invention involves a finned tube support for coat hangers. The finned tube support includes a hollow plastic tube attached to fit over a rod or pipe which is normally employed in a closet for supporting coat hangers thereon. The rod can be made of metal or wood. The rod is conventionally supplied in two standard diameters, one being about 1-1/16 inch and the other being about 1-7/16 inches. The length of the rod is dependent upon the width of the closet but will normally be between 2–6 feet in length. The ends of the rod are generally supported in grooves, notches, or holes in wood or metal pieces attached to the sides of the closet.

Thus, the hollow plastic tube will have an inner diameter slightly larger than the outer diameter of the rod upon which the tube is received. The wall thickness of the tube is preferably between 1/32 of an inch and 1/16 of an inch. Mounted on the plastic tube are a plurality of parallel circular disks or fins which are separated from each other by at least the thickness (or width) of a coat hanger. The maximum spacing will also be determined by the maximum width (or thickness) of conventional coat hangers. There are certain plastic coat hangers which are thicker (or wider) than the conventional wire coat hangers. Thus, the spacing between adjacent disks must be enough to accommodate any commercially available coat hanger.

One of the problems involved in supporting coat hangers on a rod is that the coat hangers tend to twist thereby interferring with articles on adjacent coat hangers. Therefore, the spacing between adjacent disks should be small enough or close enough to minimize the twisting problem. With both of the above considerations in mind, the spacing between adjacent disks should be between $\frac{3}{8}$ of an inch and $\frac{3}{4}$ of an inch, and preferably about 7/16 of an inch.

The disk should be made as thin as possible, but these disks must be sufficiently rigid to prevent undue bending thereof by the coat hangers; preferably, the thickness of the disk is about 1/16 of an inch. Assuming that there are a plurality of coat hangers disposed in certain of the spaces between the disks on the plastic tube, if one were to withdraw a garment by lifting one of the coat hangers away from the tube, it would be desirable to prevent contact between this garment and the end of a hook of any other hanger that might be supported on the finned tube support. Accordingly, the outer diameter of each disk is large enough that the disk extends beyond the tip of the coat hanger to prevent such contact.

When storing heavy and bulky garments, such as overcoats, it may be desirable to use only every third of fourth space to provide proper spacing between adjacent garments. The spacing between adjacent disks, however, still prevents undue twisting of the coat hanger while, at the sametime, providing sufficient space to accommodate any commercially available coat hanger.

In accordance with the basic feature of the present invention, the portion of the plastic tube between each pair of adjacent disks is provided with a centering recess for centering a coat hanger between the disks. This centering recess is provided in several different shapes and/or types. In one form of the invention the centering recess is provided by a continuous concave surface which begins at location at or adjacent the peripheries of adjacent disks jand which extends inwardly to a point of minimum diameter at a center location between adjacent disks. In additional embodiements of the invention the concave surface described above is interrupted, or indented, at the center to provide centering notches of various sizes and shapes. For example, the notch can have a single concave shape, a single cylindrical shape, a stepped concave shape, a stepped cylindrical shape, a V-shape, etc. The centering recess can also be formed by a pair of inclined (conical) surfaces which taper inwardly from the disks to form a "V" at the center; the latter centering recess can be modified in the same manner as the concave recess by adding a central notch of the same configurations referred to above.

DETAILED DESCRIPTION OF THE PREFERRED EMBODIMENTS

Figure 1:
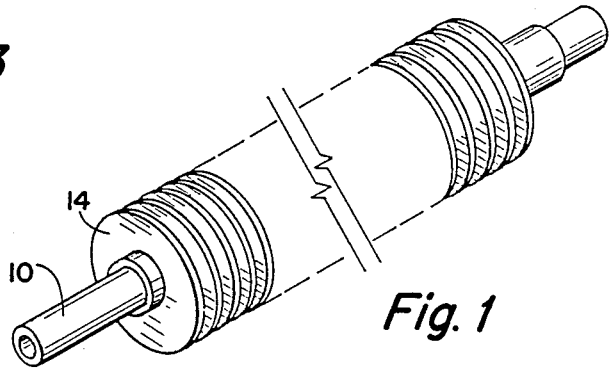
FIG. 1 is a perspective of the finned tube support of the present invention shown mounted on a rod.

Referring to the drawings in detail, FIG. 1 shows a rod 10 of the type normally employed in closets or the like for supporting coat hangers thereon. The rod 10 can be metal or wood. These rods are conventionally supplied in two standard diameters one being about 1-1/16 inch and the other being about 1-7/16 inches; the length of these rods will vary, of course, depending upon the width of the closet, but will normally be between 2 feet to 6 feet in length. When the rod 10 is made of wood it is generally solid, but when the rod 10 is metal it is generally a standard hollow pipe. The ends of the rod are generally supported in grooves or notches or holes (not shown) in word or metal pieces (not shown) attached to the sides of the closet.

The present invention involves a hollow plastic tube 12 having an inner diameter slightly larger than the outer diameter of the rod 10 which normally hangs in a closet (not shown) at about eye level and upon which the tube is received. This invention constitutes an improvement over the invention set forth in my co-pending application Ser. No. 442,301, filed Nov. 17, 1982 and entitled "Finned Tube Support for Coat Hangers". The wall thickness of the tube 12 is preferably between 1/32 and 1/16 inch thick. The plastic tube 12 is provided with a plurality of parallel circular disks or fins 14 separated from each other by at least the thickness (or width) of a coat hanger. It is recognized that there are numerous different types of coat hangers available in the marketplace; some of these hangers are made of plastic and are thicker than the conventional wire coat hanger. Thus, the spacing between adjacent disks 14 is at least equal to the width of any commericially available coat hanger.

Figure 2:
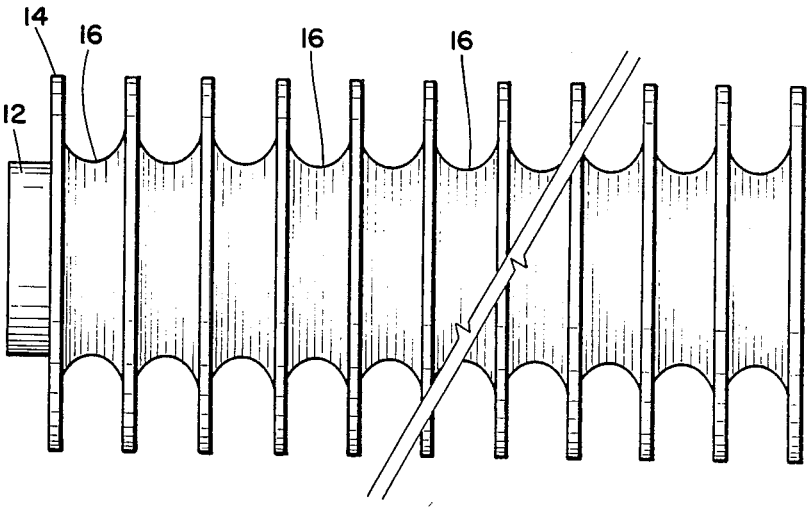
FIG. 2 is a side view of the finned tube support itself with the center portion broken out.

As best shown in FIG. 2, the portion of the tube 12, between adjacent disks 14 is preferably filled in or curved to form a smooth concave recess 16 to receive a coat hanger 18 therein. This curvature 16 tends to center the coat hangers 18 to prevent them from twisting. This curvature 16 will also be sufficient to accommodate a larger plastic coat hanger 20 such as shown in FIGS. 5, 11, 12, 13, 20 and 21.

Figure 3:
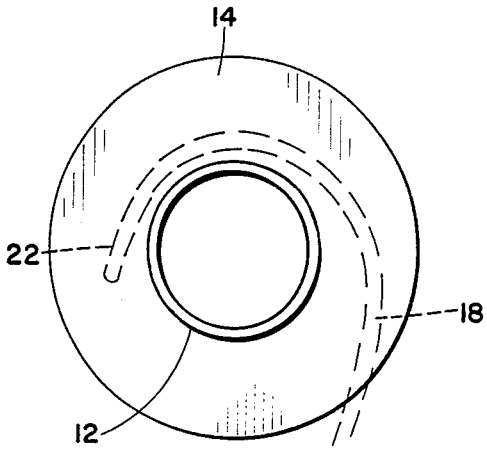
FIG. 3 is an end view of the support shown in FIG. 2 with the hook portion of a coat hanger being shown in phantom.

The diameter of the disks 14 is preferably large enough so that the outer periphery of each disk would extend beyond the location of the tip 22 of a wire coat hanger 18 diagamatically shown in FIG. 3.

One of the main differences between the invention shown in FIGS. 1 to 3 of the present application and the disclosure in my aforementioned co-pending application is that the configuration of the surface of the tube between adjacent disks in the co-pending application is cylindrical. However, as indicated above, the surface configuration of the tube between adjacent disks in FIGS. 1 to 3 of the present invention is concave to provide an automatic centering feature. FIGS. 4 through 21, inclusive, show alternate forms of centering.

Figure 4:
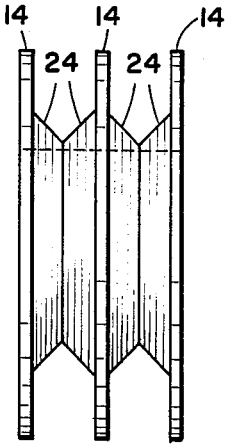
FIGS. 4 through 21, inclusive, are side views, similar to the left hand portion of FIG. 2, but showing alternate embodiments of the present invention.

FIG. 4 shows a centering arrangement where the space between disks 14 is formed by conical (inclined) surfaces 24 which extend downwardly and inwardly between adjacent disks to form a V-shaped notch.

Figure 5:
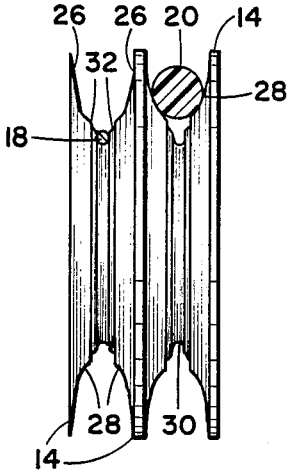

FIG. 5 shows a centering arrangement formed by multiple surfaces; starting adjacent the outer peripheries of the disks 14, a pair of steeply inclined (conical) surfaces 26 extend downwardly and inwardly until they merge with an inner concave surface 28 which is interrupted at its center by a notch formed from an inner and smaller concave recess 30 separated from the outer concave surface 28 by inclined shoulders 32. The outer concave surface 28 is configured to accommodate a larger plastic coat hanger 20, as shown, whereas the inner concave recess 30 is configured to accommodate a small wire hanger 18.

Figure 6:
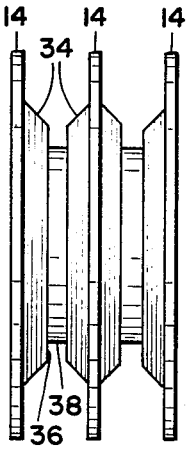

The centering arrangement shown in FIG. 6 is provided by a pair of inclined (conical) surfaces 34 which extend downwardly and inwardly toward the center between adjacent disks; instead of meeting at the center, as in the case of FIG. 4, the surfaces 34 terminate short of the center as a result of a gap or notch 36 provided at the center. The innermost portion of the notch 36 is formed by a short cylindrical surface 38.

Figure 7:
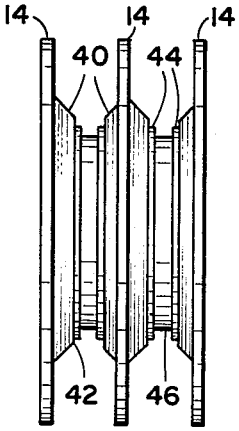

FIG. 7 shows a centering arrangement which is somewhat similar to that shown in FIG. 6. However, inclined surfaces 40 (which are similar to inclined surfaces 34, FIG. 7) are inclined downwardly and inwardly towards the center between adjacent disks 14, but these inclined surfaces 40 terminate short of the center to provide a wider notch 42 (wider than the notch 36 in FIG. 6). This notch 42 is provided with stepped surfaces formed by indented cylindrical shoulders 44 and a central cylindrical surface 46 of lesser diameter that the shoulders 44.

Figure 8:
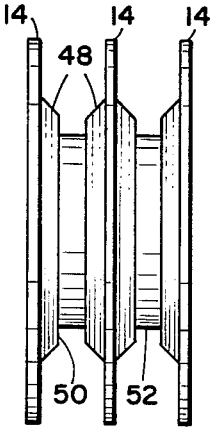

FIG. 8 is also similar to FIG. 6; the centering feature of FIG. 8 involves a pair of inclined (conical surfaces) 48 which are similar to the surfaces 34 shown in FIG. 6. However, the surfaces 48 extend downwardly and inwardly towards the center between the disks but terminate to form a notch 50 which is wider than the notch 36 shown in FIG. 6. The innermost portion of the notch 50 is formed by a cylindrical surface 52 which is essentially of the same diameter as the surface 38 shown in FIG. 6 but which is wider as a result of the increased width of the notch 50 as compared to the notch 36.

Figure 9:
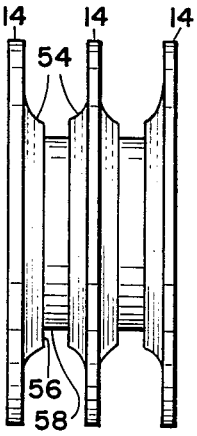

FIG. 9 is similar to FIG. 8; however, the centering feature of FIG. 9 is provided by a pair of concave surfaces 54 which, in a sense, replace the inclined surfaces 48 of FIG. 8. The concave surfaces 54 do not connect together in the center between the disks 14 but are interrupted by a notch 56 which essentially the same size as the notch 50 in FIG. 8. The innermost portion of the notch 56 is formed by a cylindrical surface 58 which is essentially the same as the cylindrical surface 52 of FIG. 8.

Figure 10:
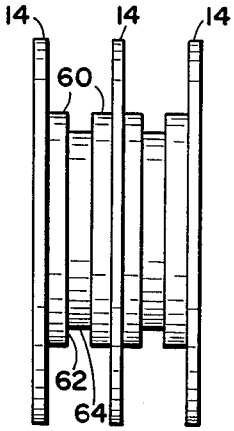

FIG. 10 shows a centering feature where the surfaces between adjacent disks are all cylindrical; thus, FIG. 10 is provided with an outer cylindrical surface 60 which does not extend the full distance across the space between adjacent disks, but which is interrupted to form a central notch 62 the bottom portion of which is formed by an inner cylindrical surface 64 of lesser diameter than the cylindrical surface 60.

Figure 11:
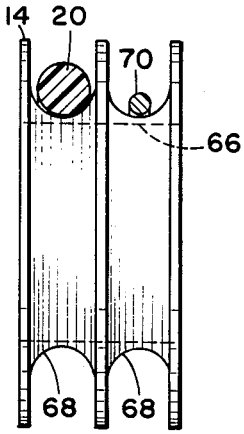

FIG. 11 shows a centering feature which is broadly similar to that shown in FIG. 2. The main difference between the FIG. 11 configuration and the FIG. 2 configuration is that the latter is principally designed to fit over the smaller sized conventional closet rod, whereas the configuration of FIG. 11 is designed to fit over the larger conventional closet rod. The dotted line 66 shown in FIG. 11 represents the outer diameter of the larger conventional closet rod. At any event, the centering feature of FIG. 11 is provided by a smooth concave recess 68 which is adapted to receive the larger sized hanger 20 as shown, an intermediate size hanger 70, as shown, or the smaller wire hanger 18 (not shown in this Figure) shown in FIGS. 3 and 12; obviously, the recess 16 would be able to accommodate the double wire hanger 72 shown in FIG. 13, but not shown in this figure.

Figure 12:
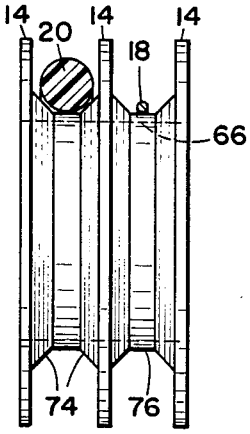

The centering feature shown in FIG. 12 is similar to that shown in FIG. 8. Again, the centering configuration of the latter figure is designed for the smaller conventional closet rod, whereas the configuration shown in FIG. 12 is specifically designed for the larger conventional closet rod, the outer diameter of which is shown in dotted lines 66. In any event, the centering feature of FIG. 12 is provided by a pair of inclined (conical) surfaces 74 which extend downwardly and inwardly towards the center between adjacent disks 14 but which do not merge as in FIG. 4; the innermost portions of the inclined surfaces 24 connect with a central cylindrical surface 76 which, as shown in this figure, is wide enough to accommodate and center the large plastic hanger 20 as well as the smallest wire hanger 18. Obviously, the surface 76 can accommodate the double wire hanger 72 shown in FIG. 13.

Figure 13:
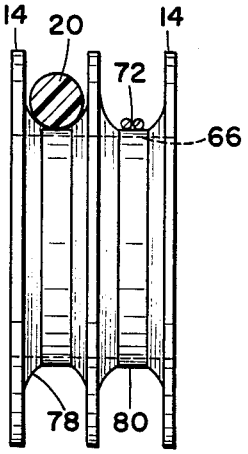

FIG. 13 shows a centering arrangement similar to that shown in FIG. 12; the inclined (conical) surfaces 74 of FIG. 12 are replaced by a concave surface 78 which, at its center, merges with a central flat (cylindrical) recess 80 which is essentially the same as the surface 76 in FIG. 12. The curvature of the concave recess in FIG. 13 is sufficient to accommodate and center the hook of a plastic coat hanger 20, but is also wide enough that a double wire hanger 72 can be further centered in the cylindrical indent 80. The configuration shown in FIG. 13 is also specifically designed for the larger conventional closet rod, the outer diameter of which is shown in dotted lines 66.

Figure 14:
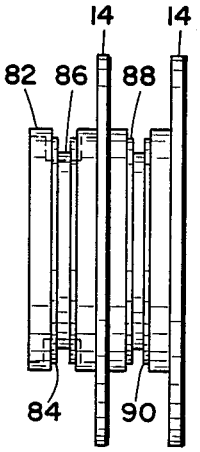

FIG. 14 shows and embodiment with stepped cylindrical surfaces starting from an outer cylindrical surface 82, a first indented cylindrical surface 84, and a third and deeper cylindrical recess 86 which forms shoulders 88 and 90 at the sides of the first cylindrical indent 84. The main cylindrical indent 84 would accommodate the double wire hanger 26 shown in FIG. 13 and it would provide a centering feature for the larger plastic coat hanger 20 also shown in FIG. 13. The inner cylindrical indent 86 would accommodate a single wire hanger such as the hanger 18 shown in FIG. 3.

Figure 15:
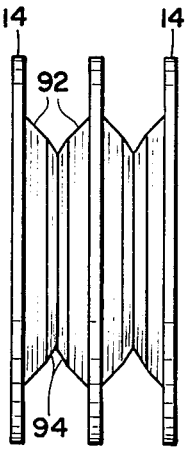

FIG. 15 represents a centering feature between adjacent disks formed by a double taper. Adjacent the fins 14 are two surfaces 92 which project downwardly and inwardly towards each other at the same downward angle. Short of the center between the disks 14 these two surfaces 92 merge with two additional surfaces 94 which taper downwardly and inwardly towards each other at an even steeper angle to form a "V" at the very center.

Figure 16:
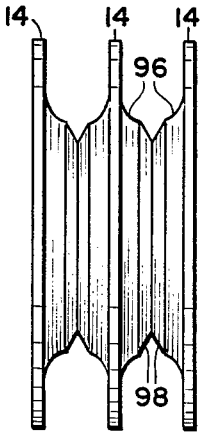

FIG. 16 is similar to FIG. 15 except that the surfaces 96 extending downwardly from adjacent disks 14 are concave but they merge with central tapered surfaces 98 which are essentially the same as the tapered surfaces 94 of FIG. 15.

Figure 17:
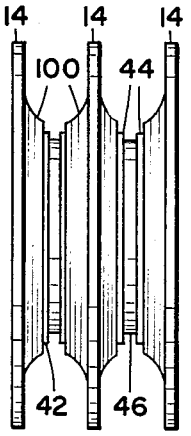

FIG. 17 is similar to FIG. 7. The main difference between these two figures is that the inclined surfaces 40 of FIG. 7 are replaced by concave surfaces 100. These concave surfaces also terminate short of the center between the disks 14 to provide a wide notch 42 which is essentially the same as the wide notch 42 of FIG. 7. Also, as in the case of FIG. 7, this notch 42 of FIG. 17 is provided with stepped surfaces formed by indented cylindrical surfaces 44 and a central cylindrical surfaces 46 of lesser diameter than the shoulders 44.

Figure 18:
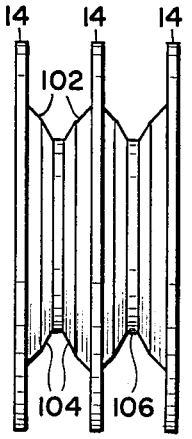

FIG. 18 is provided with two sets of inclined (conical) surfaces with a central cylindrical recess; that is, the centering arrangement in FIG. 18 is provided by a first pair of inclined (conical) surface 102 which extend downwardly and inwardly from adjacent disks 14. These inclined surfaces 102 merge with a second pair of inclined surfaces 104 which extend downwardly and inwardly at a steeper angle than the surface 102. The inner ends of the surface 104 connect with a central cylindrical surface 106.

Figure 19:
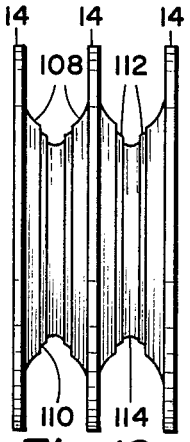

FIG. 19 is similar to FIGS. 7 and 17; however in FIG. 19 essentially all of the surfaces are concave. Thus, the centering feature in FIG. 19 is provided, first of all, by a pair of concave surfaces 108 which are similar to the center between the disks 14 to provide a notch 110 which is similar to the notch 42 of FIGS. 7 and 17. The interior of the notch, however, is somewhat different from the interior of the notch described in FIGS. 7 and 17 in that the shoulders 112 are concave as is also the central surface 114 representing the innermost indented portion of the notch 110.

Figure 20:
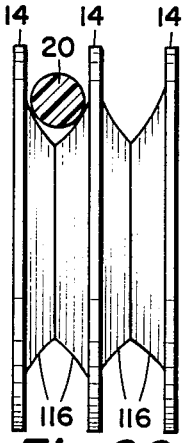

FIG. 20 is similar to FIG. 4. The inclined surfaces 24 of FIG. 4 are replaced by concave surfaces 116 in FIG. 20. These surfaces 116 intersect at the center to form an essentially V-shaped notch.

Figure 21:
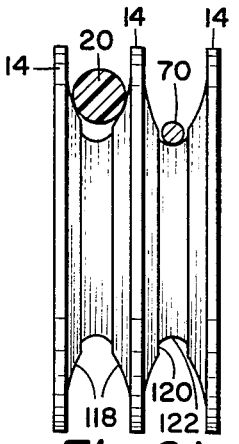

FIG. 21 is similar to FIG. 9 which in turn is similar to FIG. 8. The centering feature of FIG. 21 is provided by a pair of concave surfaces 118 which are broadly similar to the concave surfaces 54 of FIG. 9. These concave surfaces 118 are interrupted by a notch 120 which is essentially the same as the notch 56 of FIG. 9. The innermost portion of the notch 120 is formed by an inner concave surface 122 as contrasted with the cylindrical surface 58 of FIG. 9.

The configurations showing two notches are represented by FIGS. 5, 7, 14, 17 and 19. The innermost notch (of the smaller diameter) is designed to hold a single wire hanger whereas the second or intermediate notch (of larger diameter) is designed or sized to hold a double wire hanger or a single large metal hook such as is found on many wooden hangers.

The configurations having a single notch are represented by FIGS. 6, 8, 9, 10, 16, 18 and 21. With respect to the single notch referred to in these figures, this notch is wider than the innermost notch of the two notch configurations described in the preceeding paragraph and is designed to hold a single wire hanger, a double wire hanger or a single large wire hanger hook such as is found on many wooden hangers.

Whereas the prevent invention has been described in particular relation to the drawings attached hereto, it should be understood that other and further modifications apart from those shown or suggested herein, may be made within the spirit and scope of this invention.

What is claimed is:

1. A coat hanger support comprising a hollow plastic tube of sufficient length and sufficient internal diameter to slip over a closet rod of the type normally employed for holding hangers thereon in a closet; a plurality of circular plastic disks mounted in spaced parallel relation on the tube and at right angles to the longitudinal central axis of the tube, the spacing between adjacent disks being between $\frac{3}{8}$ of an inch and $\frac{3}{4}$ of an inch, said disks having an outer diameter such that the disks would extend beyond the location of the tip of a coat hanger which was supported on said tube, the plastic tube being provided with a centering recess between each pair of adjacent disks for centering a coat hanger between the disks.

2. A coat hanger support as set forth in claim 1 wherein the centering recess is formed by a concave surface.

3. A coat hanger support as set forth in claim 2 wherein the concave centering recess is further provided with a central recessed notch.

4. A coat hanger support as set forth in claim 3 wherein the notch is cylindrical.

5. A coat hanger support as set forth in claim 3 wherein the notch is of a stepped cylindrical configuration formed by a center cylindrical portion of minimum diameter positioned between a pair of cylindrical shoulders of slightly greater diameter than the minimum diameter.

6. A coat hanger support as set forth in claim 3, wherein the notch is provided with a concave center portion of minimum diameter interpositioned between a pair of inclined shoulders having inclined surfaces tapering inwardly towards the center.

7. A coat hanger support as set forth in claim 3 wherein the notch is formed by a pair of conical surfaces tapering inwardly from the concave surface to form a central V-shape.

8. A coat hanger support as set forth in claim 7 where the sides of the concave surface extend outwardly to the periphery of the disks.

9. A coat hanger support as set forth in claim 3 wherein the notch has a simple convex shape of smaller curvature than the main convex recess.

10. A coat hanger support as set forth in claim 1 wherein the centering recess is provided with a pair of conical surfaces extending inwardly from the adjacent disks towards the center between the disks.

11. A coat hanger support as set forth in claim 10 wherein the centering recess is provided with a further central cylindrical recess.

12. A coat hanger support as set forth in claim 10 wherein the centering recess is provided with a further stepped annular recess formed from a central cylindrical portion of minimum diameter positioned between a pair of cylindrical shoulders of greater diameter than the minimum.

13. A coat hanger support as set forth in claim 10 wherein the centering recess is provided with a further annular groove formed by a second pair of conical surfaces tapering inwardly at a steeper angle than the first mentioned pair of inclined surfaces to form a V-shaped notch.

14. A coat hanger support as set forth in claim 13 wherein the extreme central portion is provided with an inner cylindrical surface.

15. A coat hanger support as set forth in claim 10 wherein the centering recess is provided with a further central recess formed by a second pair of conical surfaces tapering inwardly at a steeper angle than the first mentioned pair of conical surfaces, the second pair of conical surfaces extending from the first conical surfaces to a central notch constituted by an indented cylindrical surface.

16. A coat hanger support as set forth in claim 10 wherein the conical surfaces emerge with a central cylindrical surface.

17. A coat hanger support as set forth in claim 1 wherein the portion of the tube between adjacent disks is cylindrical but is provided with a central recessed groove constituting the centering recess.

18. A coat hanger support as set forth in claim 16 where the centering recess is also cylindrical.

19. A coat hanger as set forth in claim 16 wherein the centering recess is of a stepped configuration formed by a central cylindrical portion of minimum diameter arranged between a pair of cylindrical shoulders of greater diameter than the minimum diameter.

20. A coat hanger support as set forth in claim 1 wherein the centering recess is formed by two concave surfaces which intersect with each other adjacent the center between adjacent disks to form a curved V-shaped recess.

* * * * *

UNITED STATES PATENT AND TRADEMARK OFFICE

CERTIFICATE OF CORRECTION

PATENT NO. : 4,577,766

DATED : March 25, 1986

INVENTOR(S) : Charles R. Miller

It is certified that error appears in the above-identified patent and that said Letters Patent are hereby corrected as shown below:

Column 1, line 23, change "422,301" to

- - 442,301 - -

Signed and Sealed this

Twenty-fifth Day of November, 1986

*Attest:*

DONALD J. QUIGG

*Attesting Officer* *Commissioner of Patents and Trademarks*